US006731887B1

(12) United States Patent
Wibbels et al.

(10) Patent No.: US 6,731,887 B1
(45) Date of Patent: May 4, 2004

(54) DUPLEX IMAGE REGISTRATION

(75) Inventors: Mark J. Wibbels, Boise, ID (US); Kenneth E. Heath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/285,086

(22) Filed: Oct. 30, 2002

(51) Int. Cl.[7] ..... G03G 15/00
(52) U.S. Cl. ..... 399/45; 399/394
(58) Field of Search ..... 399/45, 196, 394, 399/396, 401, 313; 355/55; 347/248–250; 358/296, 300, 451

(56) References Cited

U.S. PATENT DOCUMENTS 4,782,371 A * 11/1988 Yokota ..... 355/55
4,792,828 A * 12/1988 Ozawa et al. ..... 355/55
5,282,001 A 1/1994 Watson
5,285,247 A * 2/1994 Itoh ..... 358/300
5,725,211 A 3/1998 Blanchard et al.
5,930,577 A 7/1999 Forsthoefel et al.
6,118,950 A 9/2000 Wibbels et al.
6,201,937 B1 3/2001 Folkins
6,208,826 B1 * 3/2001 Yoshinaga et al. ..... 399/318
6,219,516 B1 4/2001 Furst et al.
6,496,678 B2 * 12/2002 Metzler et al. ..... 399/401
2003/0043246 A1 * 3/2003 Codos ..... 347/102
2003/0043256 A1 3/2003 Conrow et al.

FOREIGN PATENT DOCUMENTS

JP 9-50222 A * 2/1997

* cited by examiner

*Primary Examiner*—Joan Pendegrass

(57) ABSTRACT

A method of aligning and registering duplex images in the process direction using an imaging device, such as a printer including the steps of applying a first image to a first side of a media, modifying one or more imaging parameters of the imaging device after the first image is applied, and applying a second image to a second side of the media using the modified imaging parameters.

23 Claims, 3 Drawing Sheets

DUPLEX IMAGE REGISTRATION

BACKGROUND

Simplex printing includes printing or imaging only a single side of a page or sheet of media. Printing or imaging both sides of the page or sheet media is known as duplex printing. Both simplex and duplex printing are utilized by a variety of imaging devices, including printers, copiers, facsimile devices and the like.

When duplex printing is performed, the alignment or registration of the images on the front and back side of the page may become especially important, as any misalignment of the front and back images may produce an undesirable visible discontinuity. Examples include the misalignment of margins on facing pages when a stack of pages are folded to make a booklet, or misregistration of images on the first and second sides of a single sheet when viewed through the media, as when a page is viewed against a light background.

Although conventional image alignment and registration technologies do attempt to properly align the front and back images of a duplex-printed sheet, current techniques may not adequately compensate for changes that may occur in the size and shape of the media during the printing process.

SUMMARY

A method of printing is provided wherein the method includes applying a first image to a first side of a medium, modifying one or more imaging parameters of the imaging device so that a second applied image will be brought substantially into registration with the first image, and applying a second image to a second side of the media using the modified imaging parameters.

DETAILED DESCRIPTION

Figure 1:
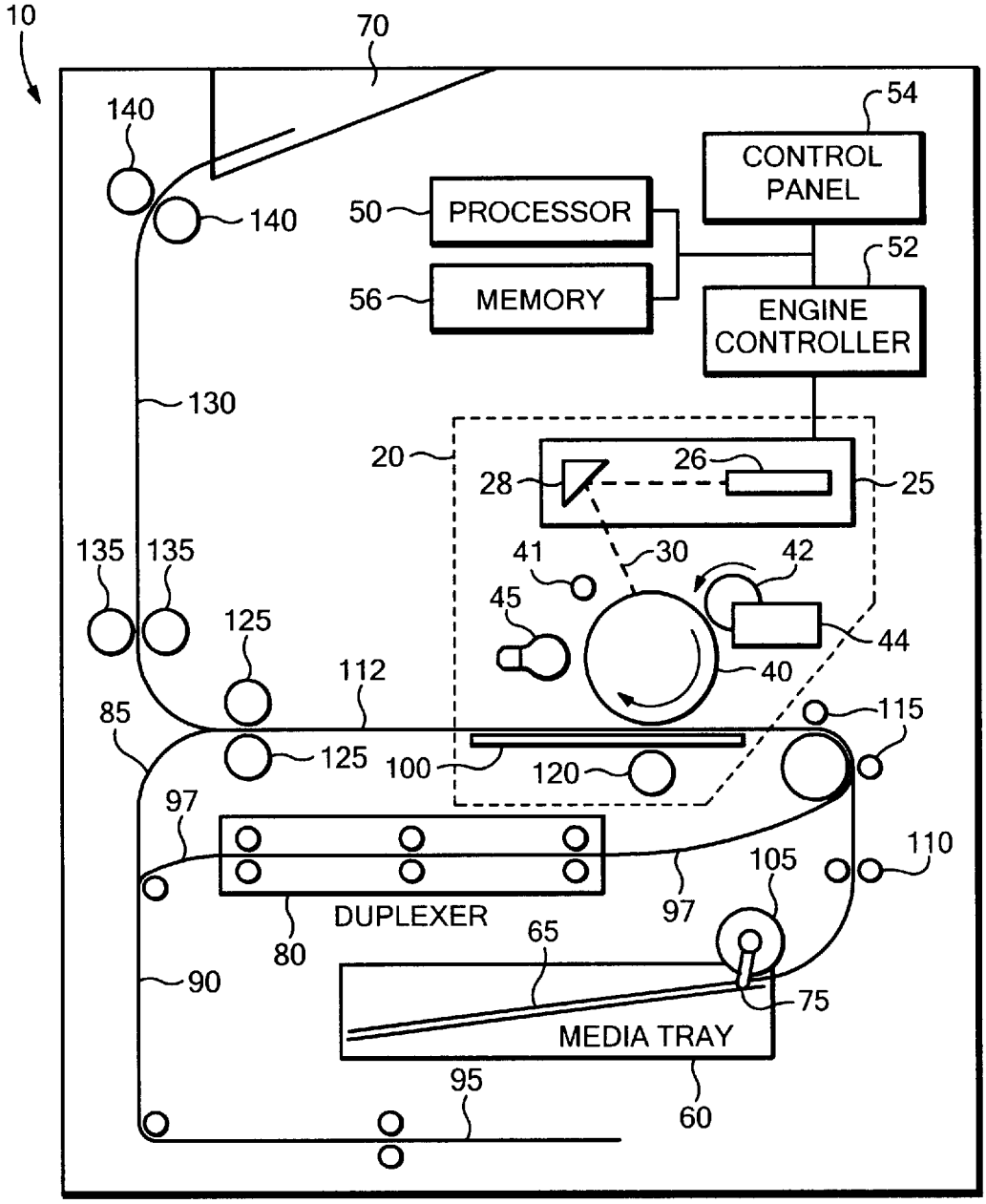
FIG. 1 is a cross-sectional view, in schematic diagram, of an electrophotographic printer employing principles of an embodiment of the present invention for duplex image registration.

FIG. 1 is a somewhat schematic cross-sectional view of an imaging device 10 employing principles in accordance with an embodiment of the present invention. Although imaging device 10 is shown and discussed herein as an electrophotographic printer having duplexing capabilities, it will be understood by those of ordinary skill in the art that the present methodology is equally applicable to other image-forming devices, color or monochrome, such as inkjet printers, photocopiers, facsimile machines and the like. The present methodology is also applicable to in-line color electrophotographic (EP) devices, EP devices using an intermediate transfer belt or using no intermediate transfer mechanism, single or dual heated fusing roller configurations, and to duplexing mechanisms, paths and configurations beyond those shown and described herein.

Additionally, the discussion of media, in general, is understood to include opaque and transparent media, whether it be paper sheets, paper rolls, plastic sheets (such as overhead transparencies), vellum sheets, envelopes, cardstock or the like. Moreover, many conventional components omitted from the drawing are omitted to maintain clarity with respect to the general interplay of components and media processing paths for duplex printing as they relate to the present embodiment of the invention.

Figure 2:
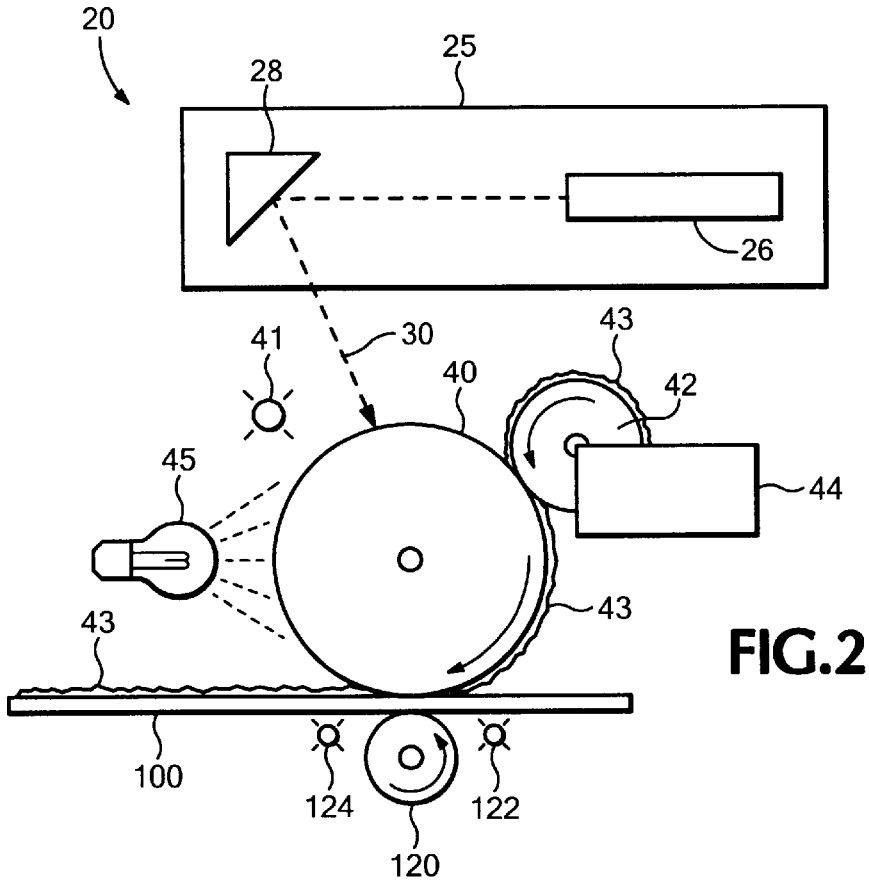
FIG. 2 is a similarly cross-sectional, schematic, enlarged view of the print engine of the electrophotographic printer of FIG. 1.

Now, in reference to FIGS. 1 and 2, it will be noted that printer 10 may be a laser printer including a print engine 20. Print engine 20 itself includes an optical photoconductive drum (OPC drum) 40 and laser scanning unit 25. Print processor 50 typically receives print data from a host system (not shown), and forms a raster print data stream. The raster print data stream is sent to an engine controller 52 for conversion to a format suitable for controlling the pulsing of laser beam 30. A control panel 54 may be disposed on an external surface of printer 10, and coupled to processor 50 for enabling a user to directly interact with, and control, printer 10. Typically, control panel 54 includes buttons, switches, or the like, and a display area such as a liquid crystal display (LCD). Memory 56 typically stores data and routines to enable the operation of printer 10. Memory 56 includes data, routines and/or executable instructions for enabling duplex image alignment on printer 10 under principles of the present embodiment of the invention. It should be noted, however, that the data, routines and/or executable instructions stored in memory 56 may also be implemented in software, or hardware components, as should be obvious to those of ordinary skill in the art.

Printer 10 may further include media input tray 60 and biased bed 65 for holding media which is to be processed through the printer. Output tray 70 may be provided to receive processed media. Although printer 10 is shown with one input tray 60 and one output tray 70, it should be apparent that any number of input and/or output trays may be employed. Sensor 75 may be configured to detect whether media is available on bed 65. Duplexer 80, and duplexing media path 85, 90, 95, 97, may enable duplex imaging in printer 10.

In operation, print engine 20 may apply a charge to the surface of OPC drum 40 using a corona wire 41. A corona wire is a metallic wire that is stretched parallel to the OPC drum and subjected to a high voltage, causing a corona discharge to occur from the wire. Alternatively, a charged roller may be used to apply a charge to the OPC drum. As OPC drum 40 rotates, laser scanning unit 25 may scan a laser beam across the surface to discharge selected points on the OPC drum surface. The pattern that the laser scanning unit applies to the OPC drum surface corresponds to the image to be printed, typically as an electrostatic image on the OPC drum surface. After the electrostatic image has been 'painted' by laser beam 30, the OPC drum surface may be rotated into contact with developer roller 42, which then transfers toner 43 (FIG. 2) from a toner hopper 44 to the surface of the OPC drum. The toner, or developer, is typically a fine black powder, that itself has an electrostatic charge. The charge applied to the OPC drum may be selected such that the toner particles cling to the discharged areas of the OPC drum surface, but do not cling to the areas of the OPC drum surface that retain a charge. In this case, the laser scanning unit paints a 'positive' of the desired image. Alternatively, the charge applied to the OPC drum may be selected such that the toner particles cling to only the non-discharged areas of the OPC drum surface. In this case, the laser scanning unit paints a 'negative' of the desired image.

The OPC drum may rotate further until it comes into contact with media 100. Media 100 typically is given an applied electrostatic charge by a transfer corona wire 122. The charge applied to the media typically has an appropriate polarity and is sufficiently strong so that the toner particles adhere to the media as transfer roller 120 applies the media to the OPC drum surface. To prevent the media from clinging to the OPC drum surface, the charge on the media may be removed by a corona wire 124 (sometimes referred to as a detac corona wire). Media 100, now including an applied image composed of applied toner particles, then may pass between fuser rollers 125 that are typically heated to a sufficiently high temperature that the loose toner powder melts and fuses with the surface of the media, fixing the applied image to the media. Alternatively, the toner may be fused to the surface of the media by first melting the toner particles with a high temperature lamp followed by compression by a pressure roller. It should be appreciated that any method of fusing the toner to the media is an appropriate method for the purposes of this embodiment of the invention.

After depositing the toner powder onto the media, the surface of the OPC drum may be exposed to a discharge lamp 45, erasing the electrical image originally applied by the laser scanning unit. The surface of the OPC drum may optionally be contacted by a rubber blade (not shown), or other physical means for removing untransferred toner from the drum. The drum surface may then be rotated near corona wire 41, reapplying a surface electrostatic charge, and enabling further printing.

To further explain the general workings of printer 10, upon initiation of a single sided (non-duplex) print job, media 100 may be picked from bed 65 by pick roller 105 and passed through transport rollers 110 and skew rollers 115 to transfer roller 120 and OPC drum 40 for imaging of the media on a first side. Once the image is transferred to the first side, media 100 may continue along media processing path 112, on through fuser rollers 125 where the toner is fused to the media. Subsequently, media 100 may be passed along media path 130 through transport rollers 135, 140, and finally to output bin 70.

Upon initiation of a duplex print job, the same initial processing path 112, just described for non-duplex printing, may be followed. A first side (typically a "back" side) of media 100 may be imaged first and then media 100 may be directed down into duplexing path 85, 90, 95. Subsequently, media 100 may be brought back up path 95 and 90 to path 97 for capture and media alignment by duplexer 80. Then, when data is ready for imaging on the second side (typically a "front" side) of media 100, the media may be transported further up path 97, through skew rollers 115, and back to transfer roller 120 for imaging of the second side. The second side thus may be presented for imaging because of the inverting effect due to it having been drawn down through duplexing path 85, 90, 95, and back through path 97 and duplexer 80. Subsequently, the image applied to the second side may be fused by rollers 125, and the media directed up path 130 and ejected into output bin 70 with its second side facing down. The first side, as defined above, may correspond to the second sheet of the printed document, and the second side may correspond to the first sheet of the printed document. However, for the purposes of this illustration, the first side is the side of the media that is imaged first.

Unfortunately, the print process described above may alter one or more dimensions of the media used. This alteration may be an increase or a decrease in the size of the media in one dimension or both dimensions of the media that is associated with any aspect of the printing process. Although the alteration experienced by a particular media is dependent upon the media type, for most paper media, the print process does result in shrinkage of the media. The shrinkage may be caused when the media is exposed to the high temperatures typically required to fuse the toner particles and create a permanent image. This media shrinkage may occur in one or both of: (1) the dimension parallel to the direction of travel through the printer (the process direction); and (2) the dimension perpendicular to the direction of travel through the printer (the scan direction).

During single-sided printing, alterations in media size due to the printing process may be ignored. However during duplex printing, there may be a differential effect to the first and second imaging processes. Although the duplexed media is exposed to the print process twice, and therefore may be altered in size twice, the second applied image is typically only exposed to the print process once. The result may be a disparity in alignment and image size between the first applied image and the second applied image. The differences in size and alignment between the first and second applied images may be noticeable, particularly when the media may be somewhat translucent, and the images are viewed against a light background or a light source.

In order to at least partially compensate for the disparity in size and alignment between the first and second applied images, the print process may be adjusted to bring the first and second applied images substantially into registration. As used herein, registration refers to both the alignment and the size of the images. The images may be placed into registration with respect to the process direction, the scan direction, or both.

Typically, the method of registering a first and a second duplex image on an imaging device according to the principles of the present invention includes applying a first image to a first side of a media, modifying one or more imaging parameters of the imaging device after the first image is applied, and applying a second image to a second side of the media using the modified imaging parameters. By careful selection of the particular imaging parameters, and the degree to which they are modified, the second image may be printed substantially in registration with the first image.

Two images may be considered to be substantially in registration when they are aligned with respect to an edge of the media, and are sized to the same image scale. Two images may be substantially in registration with respect to the process direction, the scan direction, or both directions. Typically, where images are in registration, they are in registration with respect to both the process direction and the scan direction. That is, they are placed similarly on the page, and have the same relative sizing. Typically, images are substantially in registration where the two images appear to be in registration when examined visually. Preferably, images are substantially in registration when in registration within the limits of the image resolution of the imaging device used.

Registration of the first and second images may be accomplished by modifying imaging parameters that include timing parameters associated with the application of the second image on the media. The timing parameters that may be modified include timing parameters in the process direction and the scan direction. In general, the imaging device applies the second image with an image alignment and an image size that are selected to match the alignment and size of the first image, after the first image has been altered by the printing process. As media typically shrinks somewhat upon passing through the fuser rollers, the second image is typically aligned and sized to produce a somewhat smaller image corresponding to the amount of media shrinkage during application of the first image.

Paper media is typically decreased in width or height during a print procedure. The modifications to the imaging parameters set out below are sufficient to compensate for significant size alterations in the media, and may readily compensate for the size alterations observed during image a single print procedure. Such single print processes may decrease the size of a sheet of media by less than approximately 1%, or more typically, by less than approximately 0.6%. As the amount of shrinkage for paper media is fairly consistent for a given media type, size, and relative humidity, and whereas the page size is known by the engine, the identification of the media type permits the print engine to recall from memory an appropriate correction factor and improve the alignment between the images on the first and second sides of the media by modifying one or more imaging parameters, as discussed below.

The print processor, working in conjunction with the engine controller, may calculate the amount and kind of alteration that will be exhibited by the media during processing by selecting an appropriate correction factor from a database of recorded correction factors in memory 56 (linked to the processor). The correction factors in the database are typically based upon the media type, where the media type includes the composition of the media as well as the dimensions of the media in the process and scan directions (media size). The correction factor database may be initially prepared in the laboratory by subjecting a variety of media types to the conditions associated with one or more imaging processes and recording the type and degree of the resulting size alteration for each media type. Based upon these recorded alterations, appropriate correction factors may be calculated to permit the imaging device to compensate for size alteration in duplex imaging as a function of media type. The correction factors may be stored in memory associated with the imaging device as a database, such as in the form of a "look-up table" that includes known media types. By specifying a media type, the imaging device may then recall the appropriate correction factor to be applied to the imaging parameters.

After initiation of a duplex imaging operation using the present imaging device, processor 50 may receive an identification of the media type. Any means of identifying the media type to the processor is an acceptable means for the purposes of this embodiment, including but not limited to receiving the identification of the media type from a computer associated with the imaging device, receiving the identification of the media type from one or more sensors in the imaging device itself, or receiving the identification of the media type from an input at control panel 54 of the imaging device.

Figure 4:
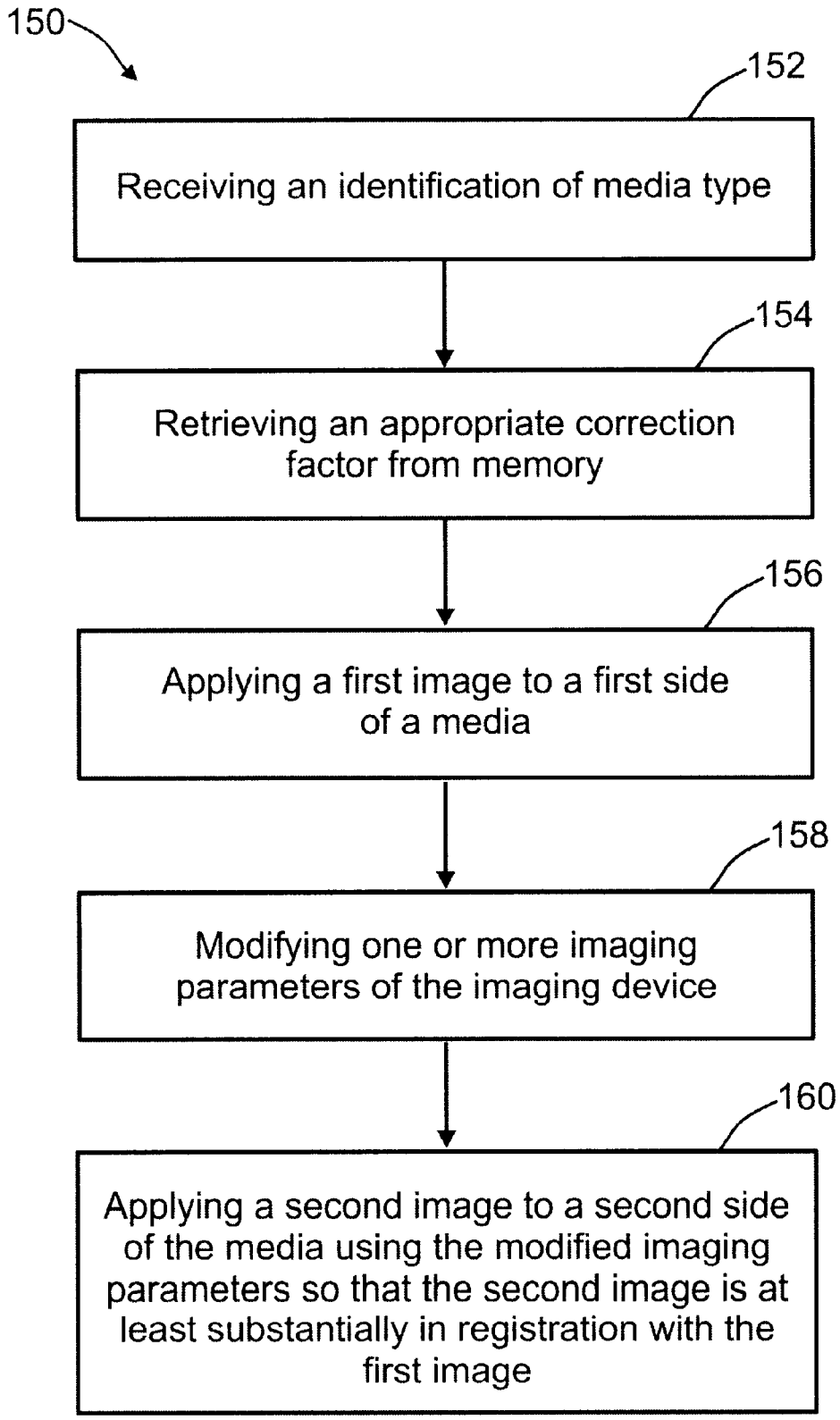
FIG. 4 is a flowchart depicting the method of duplex image alignment according to an embodiment of the invention.

A flowchart 150 depicting a method of duplex image alignment according to an embodiment of the invention is shown in FIG. 4. Upon receiving the identification of the media type, as indicated at block 152, processor 50 retrieves the appropriate correction factor. A correction factor corresponding to the identified media type thus may be retrieved from memory 56, as indicated at block 154. After application of a first image on a first side of the media, as shown at block 156, the correction factor may be applied to one or more imaging parameters of the print engine, as shown at block 158. After application of the correction factor, the second image may be applied to a second side of the media, as shown at block 160, so that the first and second applied images are substantially in registration after printing is completed. The imaging parameters that may be adjusted to bring the first and second images into registration include parameters governing imaging characteristics in the scan direction, and parameters governing imaging characteristics in the process direction.

Figure 3:
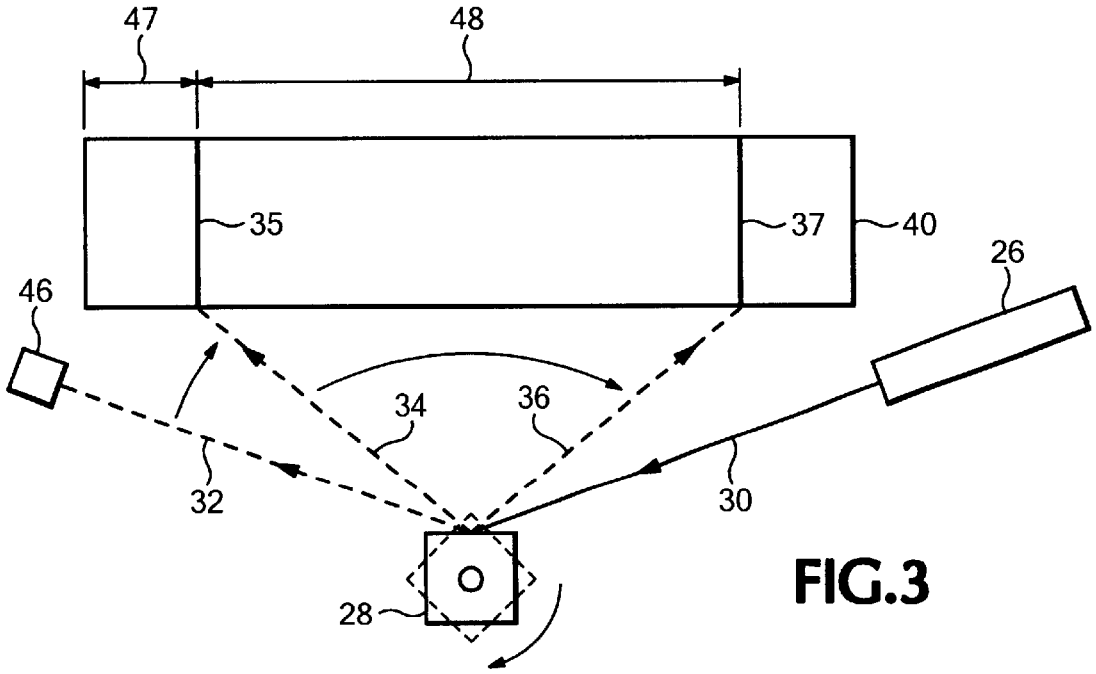
FIG. 3 is a plan view, in schematic diagram, of an optical photoconductive drum and laser assembly of the print engine of FIG. 2.

As shown in FIG. 3, laser scanning unit 25 typically includes laser 26 and a mirror assembly 28. The mirror assembly is typically a movable mirror, such as a polygonal mirror, that rotates rapidly. The laser beam 30 generated by laser 26 thus typically strikes mirror assembly 28 and is rapidly scanned across the surface of OPC drum 40. As the laser scans the drum surface, the image data received from the engine controller 52 may be applied one horizontal line at a time, as either a positive image or a negative image, depending upon the charge applied to the OPC drum and the particular configuration of the print engine. Each scanned line typically has a height of one pixel, roughly corresponding to the width of the laser beam. As the mirror assembly scans the laser beam across the OPC drum, corresponding to laser beams 32, 34, and 36, the dots that make up the pixels of the single horizontal line may be pulsed in the beam. As the mirror assembly rotates, the reflected laser beam is typically passed through a series of lenses to compensate for the distortion in the beam caused by the varying distance between the mirror and the surface of the OPC drum as the beam is scanned. After a horizontal line is scanned onto the surface of the OPC drum, the OPC drum may be incrementally rotated and the next horizontal line scanned onto the surface of the drum.

The print engine typically includes a beam detector 46 aligned with laser beam 32. As the mirror assembly rotates, the laser beam scans across detector 46. The print engine controller thus may permit a variable period of time to elapse after the detector is activated by beam 32 before the beam begins to apply image data to the surface of the OPC drum. The period of time is typically referred to as the "beam detect delay." Among the timing parameters that may be modified to effect image registration is modification of the beam detect delay between the beam detect signal and the start of image data for a given scan line. Manipulation of the beam detect delay typically alters spacing 47 by shifting image boundary 35. Decreasing the beam detect delay typically results in a decrease in spacing 47. Although depicted as sweeping the drum from left to right, beam 32 may optionally sweep the drum from right to left.

The change in the delay from the beam detect signal to the start of data write onto the OPC drum for a center-justified image may be expressed by the following equation:

$$\Delta_d = -(0.5) \times (\Delta_w)$$

where $\Delta_d$ is change in the delay from beam detect to start of data write, and $\Delta_w$ is the percent change in media dimension in the scan direction before and after imaging. The value of $\Delta_w$ for a particular media type may be recalled from an appropriate look-up table, as described above. A decrease in page size after printing may result in a negative percent change value, which yields a positive $\Delta_d$ value, and therefore, an increased delay. Similarly, an increase in page size yields a negative $\Delta_d$ value and a decreased delay. Modifications to the delay time for other types of images may be calculated similarly.

Another timing parameter associated with the application of the image data to the surface of the drum is the rate of transmission of image data for a given scan line. The rate of transmission of image data may be modified directly, by changing the frequency of the laser pulses, typically by changing the frequency of the pixel clock that governs the rate of data transmission using the laser beam. This alteration in pulse rate, coupled with the constant scan rate (that is dependent upon the rotation rate of mirror assembly 28) governs the location of the image width 48 on OPC drum 40. That is, the image border 37 may be shifted on the OPC drum to either enlarge or reduce the image in the scan direction.

The frequency of the pixel clock used for clocking out the video data may be modulated using a Phase Lock Loop (or PLL) circuit. The degree of pixel clock modulation needed depends on the expected size alteration in the media in the scan direction during imaging, which may be expressed in the following equation:

$$f_2 = \frac{f_1}{(1 - \Delta_w)}$$

where $f_2$ is the pixel clock frequency for application of the second image, $f_1$ is the pixel clock frequency used to apply the first image, and $\Delta_w$ is the percent change in media dimension in the scan direction before and after imaging. The value of $\Delta_w$ for a particular media type may be recalled from an appropriate look-up table, as described above. A decrease in page size after printing results in a negative percent change value, which yields a value for $f_2$ that is greater than $f_1$, representing an incrementally increased pixel clock frequency. Similarly, an increase in page size yields an $f_2$ value that is less than $f_1$, representing a decreased pixel clock frequency.

Alternatively, the scan rate of the laser scanning unit may be altered by modifying the rotation rate of the mirror assembly without an alteration of the clock frequency, or in combination with an alteration of the clock frequency. For example, an incrementally faster rate of mirror rotation will effectively move image border 37 by increasing image width 48.

Although the processor for the imaging device will typically apply a correction to both the beam detect delay and the data write frequency, the imaging device may apply only a beam detect delay modification, or only a data write frequency modification, if such modification will provide satisfactory registration of the first and second images.

Typically, in order to compensate for a decrease in the size of the media in the scan direction, the beam detect delay, or the time permitted to elapse between a beam detect signal and the start of transmission of image data for a given scan line, will be increased, and the rate of transmission of image data for the scan line will typically also be increased, relative to the application of the first image, during the application of the second image.

The imaging parameters may be similarly modified for print engines that utilize other types of optical assemblies. For example, an imaging device that utilizes a light emitting diode (LED) array rather than a laser scanning unit may also be modified according to the present invention. Image placement in the scan direction (X axis) may be modified by a pixel shifting process, or an LED offset, for example by transmitting image data beginning at the fifth LED in the LED array, rather than the first LED in the LED array, resulting in an offset equivalent to the width of four LED elements. Image width may be modified by mapping the image data at the desired image width onto the LED array, and thereby onto the OPC drum.

As discussed above, beam detector 46 typically detects laser beam 32 as the mirror assembly 28 sweeps the laser across the surface of the OPC drum. By altering the number of beam detects that elapse before the print engine begins to write image data onto the surface of the drum, the placement of the image in the process direction may be modified. That is, each beam detect typically corresponds to an advance of the OPC drum having the height of the scanned line. Modifying the number of beam detects that are counted from the edge of the media before image data is scanned onto the OPC drum surface may thereby move the image on the media in the process direction. An increased number of beam detects may result in a greater distance between the beginning of the media and the start of the image. A reduced number of beam detects may result in a decreased distance between the beginning of the media and the start of the image.

Alternatively, the start of image data on the media can be modifying by increasing or decreasing a timing between a media feed signal for a transfer of the media and the start of the image data. The media feed signal may correspond to the media leaving the media tray, or the media feed sensor may be located adjacent to the print engine. In either case, the imaging device may utilizes a delay that is based upon the speed of the media as it moves along the media path to the OPC drum and transfer roller in order to determine the beginning of the image on the media.

The image size in the process direction (or height) may be modified by creating a speed mismatch between transfer roller 120 and OPC drum 40. A slightly slower transfer roller rotation rate, relative to OPC drum rotation rate, may result in a decrease of transferred image height. Similarly, a slightly faster transfer roller rotation rate, relative to the OPC drum rotation rate, may create a stretched image with an increase in the height of the transferred image. Although the speed mismatch may be created by varying either the transfer roller rotation rate, the OPC drum rotation rate, or both, typically the rotation of the transfer roller is most readily manipulated to achieve the desired image sizing. Typically, in order to compensate a decrease in the size of the media in the process direction, the transfer roller speed will be incrementally decreased before applying the second image.

Although the present invention has been shown and described with reference to the foregoing operational principles and embodiments, it will be apparent to those skilled in the art that various changes in form and detail may be made without departing from the spirit and scope of the invention. The present invention is intended to embrace all such alternatives, modifications and variances which fall within the scope of the appended claims.

What is claimed is:

1. A method of printing comprising:

applying a first image to a first side of a medium;

modifying one or more imaging parameters of the imaging device that are associated with application of an image in a process direction, so that a second applied image will be brought substantially into registration with the first image; and applying a second image to a second side of the media using the modified imaging parameters;

wherein modifying the imaging parameters includes modifying a transfer roller speed before applying the second image.

2. The method of claim 1, wherein modifying the imaging parameters includes decreasing a transfer roller speed before applying the second image.

3. A method of printing, comprising:

applying a first image to a first side of a medium;

identifying a medium type for the medium, and retrieving a correction factor appropriate for the identified medium type from a memory;

modifying one or more imaging parameters of the imagine device that are associated with application of an image in a process direction, so that a second applied image will be brought substantially into registration with the first image; and applying a second image to a second side of the media using the modified imaging parameters.

4. The method of claim 3, wherein modifying one or more imaging parameters includes applying the correction factor.

5. A storage medium readable by a processor, wherein the processor is in communication with an imaging device, the storage medium having embodied therein a program of instructions executable by the processor to:

apply a first image to a first side of a medium;

identify a medium type for the medium;

retrieve an imaging parameter correction factor appropriate for the identified medium type from a database of correction factors;

apply the imaging parameter correction factor to one or more imaging parameters of the imaging device that are associated with application of an image in a process direction; and apply a second image to a second side of the medium using the modified imaging parameters, so that the second image is at least substantially in registration with the first image.

6. The storage medium of claim 5, wherein the imaging parameters include timing parameters.

7. A method of preparing a database of media correction factors, comprising:

applying an image to each of a plurality of media having distinct media types using an imaging device;

determining a kind and amount of media size alteration in the process direction due to the image application;

calculating an appropriate correction factor for the imaging device for each media type; and compiling a database relating a particular media type to the appropriate correction factor.

8. An imaging device, comprising:

a) a print engine, configured to apply a first image on a first side of a media using an imaging parameter;

b) a processor, configured to receive an identification of the media type, retrieve an appropriate correction factor from a memory, apply the correction factor to one or more imaging parameters of the print engine that are associated with application of an image in a process direction, and apply a second image to a second side of the media, so that the first and second applied images are substantially in registration.

9. The imaging device of claim 8, wherein the appropriate correction factor is associated with a particular media type in a correction factor database.

10. The imaging device of claim 8, wherein the imaging device is an electrophotographic imaging device.

11. The imaging device of claim 8, wherein the imaging device performs the function of a printer, a copier, or a facsimile device.

12. The imaging device of claim 8, wherein the processor receives the identification of the media type from one or more sensors in the imaging device.

13. The imaging device of claim 8, wherein the processor receives the identification of the media type from a computer associated with the imaging device.

14. The imaging device of claim 8, wherein the processor receives the identification of the media type from an input at a control panel on the imaging device.

15. The imaging device of claim 8, wherein the imaging parameters include timing parameters.

16. The imaging device of claim 8, wherein the corrected imaging parameter includes a modified number of beam detects occurring between a beam detect signal indicating a top of the media and a subsequent beam detect signal indicating a start of image data.

17. The imaging device of claim 8, wherein the corrected imaging parameter includes a modified timing between (i) a media feed signal for a transfer of media in the imaging device, and (ii) a start of image data.

18. The imaging device of claim 8, wherein the corrected imaging parameter includes a modified media advance rate.

19. The imaging device of claim 8, wherein the imaging device in a printer.

20. An imaging device, comprising:

means for applying a first image on a first side of a media using an imaging parameter;

identifying means for identifying the media type;

memory means for storing a plurality of correction factors; and processing means for retrieving a correction factor for the media type from the memory means, and applying the correction factor to one or more process direction imaging parameters of the imaging means so that a second image applied by the imaging means to a second side of the media is substantially in registration with the first image.

21. The imaging device of claim 20, wherein the imaging means includes an electrophotographic imager.

22. The imaging device of claim 20, wherein the imaging parameters include a timing parameter associated with applying an image via the imaging means.

23. The imaging device of claim 20, wherein the imaging parameters include one or more of a distance between a top of the media and a start of image data, or a media advance rate.

* * * * *